United States Patent [19]

Tomita et al.

[11] Patent Number: 4,696,475

[45] Date of Patent: Sep. 29, 1987

[54] THREAD-WOUND GOLF BALL

[75] Inventors: Seisuke Tomita, Tokorozawa; Yoshinori Egashira, Kodaira, both of Japan

[73] Assignee: Bridgestone Corporation, Tokyo, Japan

[21] Appl. No.: 774,743

[22] Filed: Sep. 11, 1985

[30] Foreign Application Priority Data

Sep. 11, 1984 [JP] Japan ..... 59-190080
Nov. 20, 1984 [JP] Japan ..... 59-245808

[51] Int. Cl.[4] ..... C08L 7/00; C08L 9/00; A63B 37/06

[52] U.S. Cl. ..... 273/227; 273/230; 273/235 R; 273/222

[58] Field of Search ..... 273/227, 230, 222; 525/236; 524/908; 526/337

[56] References Cited

U.S. PATENT DOCUMENTS 4,076,255 2/1978 Moore et al. ..... 273/227
4,353,557 10/1982 Kajita et al. ..... 273/227

FOREIGN PATENT DOCUMENTS 646060 7/1962 Canada ..... 273/227

*Primary Examiner*—Allan M. Lieberman
*Attorney, Agent, or Firm*—Birch, Stewart, Kolasch and Birch

[57] ABSTRACT

A thread-wound golf ball having a high impact resiliency and increased flying distance, comprising a ball core, a rubber thread layer and an outer skin layer, in which the rubber material constituting rubber thread of the rubber thread layer and/or the ball core contains more than 30 parts by weight of an isoprene-butadiene random copolymer based on 100 parts by weight of the total rubber ingredient.

15 Claims, No Drawings

THREAD-WOUND GOLF BALL

BACKGROUND OF THE INVENTION

1. Field of the Invention

This invention concerns a thread-wound golf ball with a high impact resiliency and the ability to increase flying distance.

2. Description of the Prior Art

Heretofore, one-piece golf balls, two-piece golf balls, thread-wound golf balls or the like have been known, and various attempts have been made to improve the performance of the balls in order to increase flying distance.

Among them, the thread-wound golf ball comprises a solid or liquid ball core, a plurality of highly elastic rubber thread layers tightly wound therearound and an outer skin layer or cover. Of the constituent elements, the rubber thread layer gives a most significant effect for improving the impact resiliency to increase the flying distance of the golf ball. In view of the above, it is desired to increase the impact resiliency of rubber thread constituting the rubber thread layer in order to increase the flying distance of the golf ball. As a method of increasing the impact resiliency of the rubber thread layer, polyisoprene rubber or polyisoprene rubber which has a cis-content of 90–94% has been used for the rubber thread to decrease the energy loss upon great stretching of the rubber thread, thereby increasing the impact resiliency of the golf ball. However, the method of using the polyisoprene rubber or the polyisoprene rubber which has a cis-content of 90–94% in the rubber thread involves problems wherein workability upon manufacture of the golf ball is worsened and the productivity is reduced, accompanied with the decrease in energy loss and, accordingly, some improvement has been desired therefor.

Further, in order to improve the impact resiliency for obtaining increased flying distance of the golf ball, it is desired to improve the impact resiliency and destructive strength of material constituting the ball core. While cis-polybutadiene, cis-polyisoprene or a mixture thereof has been used for the ball core, none of them can provide sufficient impact resiliency and destructive strength and an improvement is also required therefor.

SUMMARY OF THE INVENTION

Accordingly, it is an object of this invention to provide a thread-wound golf ball with improved impact resiliency and thus increased flying distance. This is accomplished by improving the impact resiliency of the rubber thread layer and/or the core, as well as protecting them from degradation during manufacture of the golf ball.

The above object of this invention can be attained by a thread-wound golf ball comprising a ball core, a rubber thread layer and an outer skin layer or cover, wherein the rubber material constituting the rubber thread of the rubber thread layer and/or the ball core contains more than 30 parts by weight of an isoprene-butadiene random copolymer based on 100 parts by weight of the total rubber ingredient.

In accordance with this invention, the use of the rubber material constituting the rubber thread of the rubber thread layer and/or the ball core which contains more than 30 parts by weight of an isoprene-butadiene random copolymer based on 100 parts by weight of the total rubber ingredient, can reduce the energy loss upon great stretching of the rubber thread and increase the impact resiliency of the rubber thread and the ball core as well as the destructive strength of the ball core, whereby the golf ball obtained therefrom has a high impact resiliency to surely attain an increased flying distance. Also, workability during manufacture of the golf ball can be improved and productivity increased significantly.

The above and other objects, features and advantages of the present invention will be more apparent from the following description.

DETAILED DESCRIPTION OF THE INVENTION

The thread-wound golf ball according to this invention comprises a ball core, a rubber thread layer and an outer skin layer or cover in which the rubber material constituting the rubber thread of the rubber thread layer and/or the core ball contains an isoprene-butadiene random copolymer.

The content of the isoprene-butadiene random copolymer in the rubber constituting the rubber thread and/or ball core is more than 30 parts by weight and, preferably, more than 50 parts by weight based on 100 parts by weight of the total rubber ingredient in view of the impact resiliency and the flying performance of the ball. If the content of the isoprene-butadiene random copolymer is lower than 30 parts by weight, the impact resiliency and the flying performance of the ball are insufficient, failing to attain the object of this invention.

The isoprene-butadiene random copolymer suitably used in this invention comprises from 5 to 90% by weight and, particularly, from 10 to 50% by weight of a butadiene component and from 10 to 95% by weight and, particularly, from 50 to 90% by weight of an isoprene component. If the butadiene component is less than 5% by weight, it may sometimes only give an insufficient effect of decreasing the energy loss upon great stretching of the rubber thread and thus less effect of improving the impact resiliency. While on the other hand, if the content is more than 90% by weight, the strength of the rubber may sometimes be decreased.

Further, in view of the microstructure of the isoprene-butadiene random copolymer, it is desired that more than 80%, preferably, more than 90% and, more preferably, more than 95% of cis-1,4 structure. If the cis-1,4 structure is less than 80%, the strength of the rubber may sometimes be poor.

Furthermore, those isoprene-butadiene random copolymers with Mooney viscosity from 30 to 100 and, particularly, from 40 to 70 can be used preferably. If the Mooney viscosity is lower than 30, the rubber may possibly flow even under the room temperature resulting in problems both in storage and in fabrication. Also, the energy loss upon great stretching of the rubber thread is increased and the performance of the golf ball may be impaired. While on the other hand, if the Mooney viscosity is higher than 100, the workability may become poor.

The isoprene-butadiene random copolymer for use in this invention may be prepared by polymerizing isoprene and butadiene in the presence of a catalyst preferably comprising a combination of a compound of a lanthanum series rare earth elements (hereinafter simply referred to as a La compound), an organic aluminum compound, a Lewis base and, if desired, a Lewis acid. The La compound usable herein can include halides, carbonates, alcoholates, thioalcoholates, amides or the like of metals having an atom number from 57 to 71. The organic aluminum compound usable herein can include those represented by the general formula: $AlR^1R^2R^3$ (wherein $R^1$, $R^2$ and $R^3$, which may be identical with or different from each other, represent individually hydrogen atom or hydrocarbon residue of from 1 to 8 carbon atoms). The Lewis base is used for converting the La compound into a complex, and acetyl acetone, ketone alcohol or the like can suitably be used, for example. The Lewis acid usable herein can include aluminum halides represented by the general formula: $AlX_nR_{3-n}$ (where X represents halogen, R represents a hydrocarbon residue and n=1, 1.5, 2 or 3) or other metal halides.

When isoprene and butadiene are polymerized in the presence of the above-mentioned catalyst, it is preferred to use a molar ratio for butadiene/La compound of, usually, from $5\times10^2$ to $5\times10^6$ and, particularly, from $10^3$ to $10^5$. Further, the molar ratio for $AlR^1R^2R^3$/La compound is preferably from 5 to 500 and, particularly, from 10 to 300. Furthermore, the molar ratio for Lewis base/La compound is preferably more than 0.5 and, particularly, from 1 to 20. If the Lewis acid is used, the molar ratio for halide in the Lewis acid/La compound is from 1.0 to 10 and, preferably, from 1.5 to 5.

The catalyst can be used for the polymerization of isoprene-butadiene in a state dissolved in a solvent or supported on silica, magnesia, magnesium chloride or the like.

Polymerization may be carried out in a solvent or through bulk polymerization without using solvent. The polymerization temperature is usually from −30° C. to 150° C. and, preferably, from 10° to 80° C. The polymerization pressure can optionally be selected depending on the conditions.

The thread material constituting the rubber thread of the rubber thread layer and/or ball core used in this invention contains an isoprene-butadiene random copolymer as described above. In this case, one or more of other rubber ingredients selected from natural rubber, synthetic isoprene rubber and butadiene rubber may preferably be used.

Further, the rubber thread for use in this invention can be blended with carbon black in such an amount as to not substantially change the energy loss upon great stretching of the rubber thread. The amount of the carbon black is usually less than 20 parts by weight and, particularly, from 0.5 to 10 parts by weight based on 100 parts by weight of the total rubber ingredient in the rubber thread. In this case, any of the ordinary carbon blacks for use in rubber blending can be used in the rubber thread and, among all, oil furnace black, particularly, FEF, HAF and HAF-LS and the like can be used satisfactorily.

Further, inorganic material such as barium sulfate, zinc white and clay may also be blended with the rubber forming the ball core for adjusting the specific gravity. The blending amount usually ranges from 40 to 150 parts by weight based on 100 parts by weight of the total rubber ingredient in the rubber material.

Furthermore, the rubber material constituting the rubber thread and/or ball core for use in this invention may optionally be blended with well-known ingredients including vulcanizing agent such as sulfur, organic sulfur compounds and organic peroxides, vulcanization accelerator such as tetramethyl thiuram disulfide, reinforcing agent such as zinc white, stearic acid, white carbon and precipitated calcium carbonate, filler such as calcium carbonate and diatomaceous earth, plasticizer such as dioctyl phthalate and tricresyl phosphate, colorant (e.g. pigments or dyes), lubricant, antioxidant such as phenyl-α-naphthylamine or 2,6-di-t-butyl-p-cresol, which are crosslinked in a conventional manner.

The rubber thread having an excellent impact resiliency of the present invention may be prepared by an ordinary production method from the above-mentioned rubber composition in a solid state or by mixing and drying the rubber composition in a latex state.

The thread-wound golf ball according to this invention can be prepared by winding the rubber thread as described above around the ball core and covering the thread rubber layer with the outer skin layer or cover. In this case, the outer skin layer may be formed with ordinary material such as balata or ionomer resin.

As described above, both the rubber thread and the ball core may be formed with the isoprene-butadiene random copolymer as the main rubber material. Alternatively, either the rubber thread or the ball core may be formed with the isoprene-butadiene random copolymer.

In this case, if the ball core is formed with the isoprene-butadiene random copolymer, the rubber thread may be formed with conventional material, for example, low cis-content polyisoprene rubber in which the cis-content is 90 to 94%. Further, if the rubber thread is formed with the isoprene-butadiene random copolymer, the ball core may be formed with conventional material, for example, cis-polybutadiene, cis-polyisoprene and a mixture thereof. Particularly, the ball core may preferably be formed with a rubber material containing more than 30 parts by weight of polybutadiene rubber having at least 80% cis-1,4 structure and more than 110 of the average chain length for the cis-1,4 structure, particularly, the rubber material obtained by using the catalyst as described above containing the lanthanum series rare earth element, in which a ball having the core ball with excellent impact resiliency and with increased flying distance can be obtained.

Specifically, it is effective to use a polybutadiene rubber containing at least 80% of the cis-1,4 structure and having the average chain length for the cis-1,4 structure of more than 110 as described above, particularly, containing more than 90% of the cis-1,4 structure and having the average chain length for the cis-1,4 structure of, preferably, from 110 to 530 and, more preferably, 130 to 530. The Mooney viscosity is preferably from 20 to 150 while there are no particular restrictions. Polybutadiene rubber prepared by polymerizing butadiene in the presence of a catalyst comprising a combination of a compound of lanthanum series rare earth elements, an organic aluminum compound, a Lewis base and, if desired, a Lewis acid is preferred and the impact resiliency of the ball core can be improved by using the polybutadiene rubber of this type.

The golf ball composition of this invention can be used for any type of golf balls such as small balls having a diameter of not less than 41.15 mm and a weight of not more than 45.92 g and large balls having a diameter of not less than 42.67 mm and a weight of not more than 45.92 g. The weight, the thickness and the like for the ball core, rubber thread layer and the outer skin layer may be selected respectively from usual ranges.

In the thread-wound golf ball according to this invention, since the rubber material constituting the rubber thread of the rubber thread layer and/or ball core contains more than 30% by weight of the isoprene-butadiene random copolymer based on the total rubber ingredient, the energy loss upon great stretching of the rubber thread is decreased and the impact resiliency of the rubber thread layer and the ball core can be improved as well as the destructive strength of the ball core, whereby a golf ball having an excellent impact resiliency with increased initial flying velocity upon hitting the ball and with increased flying distance can be obtained. Further, the workability upon manufacturing the ball is satisfactory, which is extremely advantageous for the production of the golf ball.

This invention will now be described more specifically referring to Examples and Comparative Examples. It should however be noted that this invention is no way limited only to the examples specified below.

EXAMPLES 1, 2 AND COMPARATIVE EXAMPLES 1-3

Thread rubbers of the compositions as shown in Table 1 were prepared in a roll mixing method.

Then, the tensile strength, elongation and hysteresis loss of these rubber threads at room temperature were measured. The results are also shown in Table 1.

From the results shown in Table 1, it can be seen that the rubber threads for use in this invention (Examples 1 and 2) are suitable for a golf ball having an extremely low hysteresis loss upon elongating deformation, thus having a low energy loss, a high impact resiliency, as well as satisfactory workability.

TABLE 1

| | Comparative Example | | | Example | |
|---|---|---|---|---|---|
| | 1 | 2 | 3 | 1 | 2 |
| Ingredient (parts by weight) | | | | | |
| Natural rubber | 100 | — | — | — | — |
| Synthetic isoprene rubber*1 | — | 100 | — | — | 30 |
| Synthetic isoprene rubber*2 | — | — | 100 | — | — |
| Isoprene-butadiene random copolymer | — | — | — | 100 | 70 |
| Stearic acid | 1 | 1 | 1 | 1 | 1 |
| Zinc oxide | 3 | 3 | 3 | 3 | 3 |
| Vulcanization accelerator | 0.6 | 0.6 | 0.6 | 0.6 | 0.6 |
| Anti-oxidant | 1 | 1 | 1 | 1 | 1 |
| Sulfur | 0.8 | 0.8 | 0.8 | 0.8 | 0.8 |
| Tensile strength (kg/cm$^2$) | 100 | 120 | 170 | 170 | 168 |
| Elongation (%) | 800 | 850 | 1000 | 1050 | 1000 |
| Hysteresis loss (%)*3 | 55 | 38 | 15 | 10 | 16 |
| Workability*4 | o | o | x | o | o |

*1cis-1,4 structure content: 96%

*2cis-1,4-structure content: 92%

*3Hysteresis loss was measured by stretching a test sample to a constant stress of 75 kg/cm$^2$, causing it to shrink to the initial state. The energy ratio between the stretching and the returning strokes is indicated by percent. Smaller value exhibits a smaller energy loss.

*4The rubber composition is kneaded on a roll. The workability is represented by "o" if an intact thin rubber sheet of about 2 mm thickness can be prepared and by "x" if the sheet obtained has many pores.

The process for producing the isoprene-butadiene random copolymer used in Examples 1 and 2 is shown below.

To a 5 liter autoclave, were charged under a nitrogen atmosphere 2500 g of cyclohexane, 350 g of isoprene and 150 g of 1,3-butadiene and temperature was adjusted to 60° C.

In a separate vessel, neodymium 2-ethylhexanoate/acetyl acetone/tri-isobutyl aluminum/diethyl aluminum chloride were added respectively in the molar ratio of 1:2:40:4, followed by aging at 50° C. for 30 minutes under the presence of a small amount of isoprene.

The aged catalyst was charged at a ratio of one mol of neodymium based on $1.2\times10^4$ mol of monomer and then polymerization was effected at 60° C. for 7 hours. After confirming that the conversion rate in the polymerization reached 100%, 4 g of 2,6-ditertiary-butylcatechol dissolved in 5 ml of methanol were added to terminate the reaction.

The polymer cement was poured into methanol in a conventional manner to recover the polymer and then the polymer was dried in a vacuum drier at 60° C. The amount of the recovered polymer was 480 g and its Mooney viscosity ($ML_{1+4}^{100° C.}$) was 50.

The resultant polymer has the following properties.

Isoprene 68 weight %, butadiene 32 weight %.

Isoprene bonding mode:

Cis-1,4 structure 96%, 3,4-structure 4%.

Butadiene bonding mode:

Cis-1,4 structure 95%, 3,4-structure 4%.

Random structure with no substantial isoprene-butadiene structure.

EXAMPLE 3, COMPARATIVE EXAMPLE 4

The ball cores (30 mm in diameter) having the compositions as shown in Table 2 were prepared through vulcanization at 150° C. for 15 minutes.

Then, the resiliency of these ball cores at the room temperature was measured. The destructive strength and workability are also evaluated. The results are also shown in Table 2.

From the results of Table 2, it can be recognized that the ball core for use in this invention has a higher impact resiliency than that of the conventional one and is thus suitable to the increase of the flying distance of the golf ball. The ball core of this invention also has an excellent destructive strength. The workability of the rubber composition according to the present invention is satisfactory.

TABLE 2

| | Example 3 | Comparative Example 4 | Reference Example |
|---|---|---|---|
| Ingredient (parts by weight) | | | |
| Isoprene-butadiene random copolymer *5 | 100 | — | — |
| Cis-polybutadiene*6 | — | 100 | — |
| Cis-polybutadiene*7 | — | — | 100 |
| Zinc oxide | 10 | 10 | 10 |
| Stearic acid | 3 | 3 | 3 |
| Barium sulfate | 68 | 68 | 68 |
| Vulcanization accelerator | 4 | 4 | 4 |
| Sulfur | 8 | 8 | 8 |
| Resilience (%) | 87.9 | 85.6 | 87.8 |
| Durability test*8 | not destroyed | destroyed | — |
| Workability | o | x*9 | o |

*5: The same isoprene-butadiene random copolymers as in Examples 1, 2 were used.

*6: BR01, trade name of goods manufactured by Japan Synthetic Rubber Co., Ltd. cis-1,4 structure 95% average chain length for cis-1,4 structure 106

*7: Manufactured with the use of neodymium octate/triethyl aluminum/diethyl aluminum bromide catalyst. cis-1,4 structure 96% average chain length for cis-1,4 structure 300

*8: The rubber thread comprising 70 parts by weight of natural rubber and 30 parts by weight of polyisoprene rubber (cis-1,4 structure: 92%) was wound around each of the above ball cores such that the compression of the ball was 90 degree. Then, an outer cover mainly composed of an ionomer was covered over the rubber thread layer to prepare golf balls having 42.7 mm diameter. The golf balls were made strike against a steel plate at a velocity of 50 m/sec for 400 times using an air gun. Thereafter, it was evaluated whether the ball core was destroyed or not by disassembling the ball and observing the ball core.

*9: The rubber composition became baggy when it was kneaded on a roll.

EXAMPLES 4–6, COMPARATIVE EXAMPLES 5 AND 6

Rubber threads having the compositions shown in Table 3 were prepared in a conventional manner.

Then, the rubber threads were wound around each of the ball cores having 28 mm in diameter mainly composed of polybutadiene such that the compression of the ball was 90 degrees. Then, an outer cover mainly composed of an ionomer was covered in 2.2 mm thickness over the rubber thread layer to prepare golf balls having 42.7 mm diameter.

The thus obtained balls were shot by a golf ball shotting tester (manufactured by True Temper Co.) using a No. 1 wood driver at a head speed of 46 m/sec to measure the flying distance.

The results are shown in Table 3.

TABLE 3

| | Comparative Example | | Example | | |
|---|---|---|---|---|---|
| | 5 | 6 | 4 | 5 | 6 |
| Rubber thread blend composition (parts by weight) | | | | | |
| Natural rubber | 25 | 30 | 50 | 30 | 30 |
| Synthetic isoprene rubber *1 | 25 | — | — | — | — |
| Synthetic isoprene rubber *2 | 50 | 70 | — | — | — |
| Isoprene-butadiene random copolymer *5 | — | — | 50 | 70 | 70 |
| Carbon black | — | 5 | 5 | 5 | 5 |
| Stearic acid | 1 | 1 | 1 | 1 | 1 |
| Zinc oxide | 3 | 3 | 3 | 3 | 3 |
| Anti-oxidant | 1 | 1 | 1 | 1 | 1 |
| Vulcanization accelerator | 0.6 | 0.6 | 0.6 | 0.6 | 0.6 |
| Sulfur | 1.1 | 0.8 | 0.6 | 0.8 | 0.6 |
| Ball core weight (g) | 17.3 | 17.3 | 17.3 | 17.3 | 17.3 |
| Ball hardness | appropriate | appropriate | appropriate | appropriate | appropriate |
| Ball weight (g) | 45.2 | 45.2 | 45.2 | 45.2 | 45.2 |
| Ball performance | | | | | |
| 25° C. | | | | | |
| Initial ball velocity (m/sec) | 67.5 | 67.9 | 68.0 | 68.4 | 68.3 |
| Shotting angle (degree) | 10.1 | 10.2 | 10.1 | 10.1 | 10.1 |
| Carry (m) | 206 | 209 | 211 | 214 | 212 |
| Total (m) | 222 | 224 | 227 | 231 | 230 |
| 0° C. | | | | | |
| Initial ball velocity (m/sec) | 64.7 | 65.0 | 66.0 | 66.4 | 66.2 |
| Shotting angle (degree) | 9.6 | 9.6 | 9.7 | 9.8 | 9.8 |
| Carry (m) | 185 | 187 | 193 | 195 | 194 |
| Total (m) | 205 | 207 | 213 | 215 | 215 |

*1, *2, *5: Same rubber materials as those in Examples 1, 2 respectively were used.

What is claimed is:

1. A thread-wound golf ball comprising:

a ball core containing rubber material, a rubber thread layer containing rubber material, and a cover wherein at least one of the rubber thread layer or the ball core is a mixture of an isoprene-butadiene random copolymer which contains more than 30 parts by weight of the isoprene-butadiene random copolymer based on 100 parts by weight of the total rubber ingredient and one or more rubber ingredients selected from the group consisting of natural rubber, synthetic isoprene rubber and butadiene rubber, said isoprene-butadiene random copolymer having from 5 to 90% by weight of a butadiene component and from 95 to 10% by weight of an isoprene component, and having a cis-1,4 structure content of more than 80% by weight based on the entire copolymer.

2. A thread-wound golf ball, comprising:

a ball core containing rubber material, a rubber thread layer containing rubber material, and a cover wherein the rubber material of the rubber thread layer and the ball core is a mixture of an isoprene-butadiene random copolymer which contains more than 30 parts by weight of the isoprene-butadiene random copolymer based on 100 parts by weight of the total rubber ingredient and one or more rubber ingredients selected from the group consisting of natural rubber, synthetic isoprene rubber and butadiene rubber, said isoprene-butadiene random copolymer having from 5 to 90% by weight of a butadiene component and from 95 to 10% by weight of an isoprene component, and having a cis-1,4 structure content of more than 80% by weight based on the entire copolymer.

3. The thread-wound golf ball as defined in claim 1, wherein the isoprene-butadiene random copolymer has a Mooney viscosity of from 30 to 90.

4. The thread-wound golf ball as defined in claim 1, wherein the isoprene-butadiene random copolymer is prepared by polymerizing isoprene and butadiene in the presence of a catalyst comprising a compound of a lanthanum series rare earth element, an organic aluminum compound, a Lewis base and, if desired, a Lewis acid.

5. The thread-wound golf ball as defined in claim 1, wherein the rubber material contains more than 50 parts by weight of the isoprene-butadiene random copolymer based on 100 parts by weight of total rubber ingredient.

6. The thread-wound golf ball as defined in claim 2, wherein the isoprene-butadiene random copolymer has a Mooney viscosity of from 40–70.

7. The thread wound golf ball as defined in claim 4, wherein:

the lanthanum series rare earth elements are selected from the group consisting of halides, carbonates, alcoholates, thioalcoholates, amides and metals having an atomic number from 57 to 71, or the organic aluminum compound is represented by the formula: $AlR^1R^2R^3$, wherein $R^1$, $R^2$ and $R^3$, which may be identical with or different from each other, represent individually a hydrogen atom or a hydrocarbon residue of from 1 to 8 carbon atoms, or the Lewis base is acetyl acetone or ketone alcohol, or the Lewis acid is an aluminum halide represented by the formula: $AlX_nR_{3-n}$, wherein X represents halogen, R represents a hydrocarbon residue and n=1, 1.5, 2 or 3.

8. The thread-wound golf ball as defined in claim 7, wherein:

a molar ratio for butadiene/La compound is from $5\times10^2$ to $5\times10^6$, or the molar ratio for $AlR^1R^2R^3$/La compound is from 5 to 500, or the molar ratio for Lewis base/La compound is more than 0.5, or the molar ratio for halide in the Lewis acid/La compound is from 1.0 to 10.

9. The thread-wound golf ball as defined in claim 4, wherein the catalyst is dissolved in a solvent or supported on silica, magnesia or magnesium chloride.

10. The thread-wound golf ball as defined in claim 4, wherein the polymerization temperature is from −30° C. to 150° C.

11. The thread-wound golf ball as defined in claim 1, wherein the rubber material further comprises:

a vulcanizing agent selected from the group consisting of sulfur, organic sulfur compounds and organic peroxides, or a vulcanization accelerator of tetramethyl thiuram disulfide, or a reinforcing agent selected from the group consisting, stearic acid, white carbon and precipitating calcium carbonate, or a filler of calcium carbonate or diatomaceous earth, or a plasticizer of dioctyl phthalate or tricresyl phosphate, or a pigment or dye, or a lubricant, or an antioxidant of phenyl-α-naphthylamine or 2,6-di-t-butyl-p-cresol.

12. The thread-wound golf ball as defined in claim 1, wherein the rubber in the ball core is blended with 40 to 150 parts by weight of inorganic material based on 100 parts of the total rubber ingredient in the rubber material.

13. The thread-wound golf ball as defined in claim 1, wherein the ball core comprises a rubber material containing more than 30 parts by weight of polybutadiene rubber having at least 80% cis-1,4 structure and an average chain length of between 110 and 530 length for the cis-1,4 structure.

14. The thread-wound golf ball as defined in claim 1, wherein the isoprene-butadiene random copolymer contains 10 to 50% by weight of the butadiene component and from 50 to 90% by weight of the isoprene component.

15. The thread-wound golf ball is defined in claim 1, wherein the cis-1,4 structure content is more than 90%.

* * * * *